US009765576B2

(12) United States Patent
Buytaert et al.

(10) Patent No.: US 9,765,576 B2
(45) Date of Patent: Sep. 19, 2017

(54) WRAP-AROUND STOP COLLAR AND METHOD OF FORMING

(71) Applicant: Antelope Oil Tool & Mfg. Co., LLC, Mineral Wells, TX (US)

(72) Inventors: Jean Buytaert, Mineral Wells, TX (US); Clayton Plucheck, Tomball, TX (US); Ira Eugene Hining, Houston, TX (US)

(73) Assignee: ANTELOPE OIL TOOL & MFG. CO., Mineral Wells, TX (US)

( * ) Notice: Subject to any disclaimer, the term of this patent is extended or adjusted under 35 U.S.C. 154(b) by 312 days.

(21) Appl. No.: 14/461,273

(22) Filed: Aug. 15, 2014

(65) Prior Publication Data

US 2015/0047856 A1 Feb. 19, 2015

Related U.S. Application Data

(60) Provisional application No. 61/867,023, filed on Aug. 17, 2013.

(51) Int. Cl.

| | |
|---|---|
| ***E21B 17/10*** | (2006.01) |
| ***E21B 17/04*** | (2006.01) |
| ***E21B 10/08*** | (2006.01) |
| ***E21B 17/20*** | (2006.01) |

(52) U.S. Cl.

CPC ..... *E21B 17/04* (2013.01); *E21B 10/08* (2013.01); *E21B 17/10* (2013.01); *E21B 17/1028* (2013.01); *E21B 17/20* (2013.01)

(58) Field of Classification Search

CPC ..... E21B 17/16; E21B 17/10; E21B 17/02; E21B 17/04; E21B 17/08; E21B 17/1085

USPC ..... 285/222.1, 222.2, 222.3, 54; 138/0.144

See application file for complete search history.

(56) References Cited

U.S. PATENT DOCUMENTS

| | | | |
|---|---|---|---|
| 1,201,706 | A | 10/1916 | Dodge |
| 2,368,401 | A | 1/1945 | Baker |
| 2,496,402 | A | 2/1950 | McVeigh et al. |
| 2,797,756 | A | 7/1957 | Hall, Sr. |

(Continued)

FOREIGN PATENT DOCUMENTS

| | | | |
|---|---|---|---|
| EP | 0079702 | A1 | 5/1983 |
| EP | 0088507 | A1 | 9/1983 |

(Continued)

OTHER PUBLICATIONS

Non-Final Office action dated Feb. 16, 2016, U.S. Appl. No. 14/461,297, filed Aug. 15, 2014, pp. 1-8.

(Continued)

*Primary Examiner* — Nicole Coy

(74) *Attorney, Agent, or Firm* — MH2 Technology Law Group, LLP

(57) ABSTRACT

A stop collar for a tubular and method for installing a stop collar on a tubular. The stop collar includes a flexible member extending circumferentially around the tubular more than once. A tension force on the flexible member causes the flexible member to apply a radially-inward gripping force on the tubular. The stop collar may also include a shield disposed around at least a portion of the flexible member, to protect the flexible member in a downhole environment. The stop collar may also or instead include an adhesive disposed radially between the flexible member and the tubular.

27 Claims, 11 Drawing Sheets

(56) References Cited

U.S. PATENT DOCUMENTS

| | | | | |
|---|---|---|---|---|
| 2,824,613 | A | 2/1958 | Baker et al. | |
| 3,040,405 | A | 6/1958 | Solum | |
| 2,855,052 | A | 10/1958 | Wright et al. | |
| 2,962,313 | A | 11/1960 | Conrad | |
| 2,986,417 | A | 5/1961 | Baker | |
| 3,063,760 | A | 11/1962 | Gifford | |
| 3,124,196 | A | 3/1964 | Solum | |
| 3,292,708 | A | 12/1966 | Mundt | |
| 3,360,846 | A | 1/1968 | Schellstede et al. | |
| 3,563,575 | A | 2/1971 | Sanford | |
| 3,566,965 | A | 3/1971 | Solum | |
| 3,652,138 | A | 3/1972 | Collett | |
| 3,916,998 | A | 11/1975 | Bass, Jr. et al. | |
| 4,146,060 | A | 3/1979 | Garrett | |
| 4,171,560 | A * | 10/1979 | Garrett | B23P 11/00 228/175 |
| 4,363,360 | A | 12/1982 | Richey | |
| 4,367,053 | A | 1/1983 | Stratienko et al. | |
| 4,434,125 | A | 2/1984 | Lavender et al. | |
| 4,514,245 | A * | 4/1985 | Chabrier | B29C 53/581 138/144 |
| 4,531,582 | A | 7/1985 | Muse et al. | |
| 4,651,823 | A | 3/1987 | Spikes | |
| 5,501,281 | A | 3/1996 | White et al. | |
| 5,517,878 | A | 5/1996 | Klein et al. | |
| 5,520,422 | A | 5/1996 | Friedrich et al. | |
| 5,698,055 | A | 12/1997 | Benkoczy | |
| 5,706,894 | A | 1/1998 | Hawkins, III | |
| 5,743,302 | A | 4/1998 | McNeely | |
| 5,817,952 | A | 10/1998 | Swisher et al. | |
| 5,860,760 | A | 1/1999 | Kirk | |
| 5,908,072 | A | 6/1999 | Hawkings | |
| 6,361,243 | B1 | 3/2002 | Geib | |
| 6,484,803 | B1 | 11/2002 | Gremillion | |
| 6,679,325 | B2 | 1/2004 | Buytaert | |
| 6,679,335 | B2 | 1/2004 | Slack et al. | |
| 6,957,704 | B2 | 10/2005 | Rogers et al. | |
| 7,159,619 | B2 | 1/2007 | Latiolais, Jr. et al. | |
| 8,146,662 | B2 | 4/2012 | Shoemate | |
| 8,251,138 | B2 | 8/2012 | Bonner | |
| 8,291,971 | B2 | 10/2012 | Lopez | |
| 2001/0040041 | A1 | 11/2001 | Pennington et al. | |
| 2002/0139537 | A1 | 10/2002 | Young et al. | |
| 2003/0019637 | A1 | 1/2003 | Slack et al. | |
| 2008/0035328 | A1 * | 2/2008 | Hill | E21B 17/006 166/162 |
| 2008/0156488 | A1 | 7/2008 | Thornton | |
| 2009/0229823 | A1 | 9/2009 | Moen et al. | |
| 2009/0255666 | A1 | 10/2009 | Olsen et al. | |
| 2009/0308615 | A1 | 12/2009 | Buytaert | |
| 2010/0326671 | A1 | 12/2010 | Buytaert et al. | |
| 2012/0006533 | A1 | 1/2012 | Barnard et al. | |
| 2012/0073803 | A1 | 3/2012 | Dalmia | |
| 2012/0227959 | A1 | 9/2012 | Buytaert et al. | |
| 2013/0000990 | A1 * | 1/2013 | Downie | E21B 17/1085 175/325.5 |

FOREIGN PATENT DOCUMENTS

| | | | |
|---|---|---|---|
| GB | 2304753 | A | 3/1997 |
| WO | 2007143324 | A1 | 12/2007 |

OTHER PUBLICATIONS

Patrizia Lindquist (Authorized Officer), PCT Invitation to Pay Additional Fees dated Oct. 20, 2010, PCT Application No. PCT/US2010/037441, filed Jun. 4, 2010, pp. 1-6.

Patrizia Lindquist (Authorized Officer), PCT International Search Report and Written Opinion dated Dec. 23, 2010, PCT Application No. PCT/US2010/037441, filed Jun. 4, 2010, pp. 1-16.

Author Unknown, Frank's Anaconda Stop Collar Sheet, Frank's Casing Crew & Rental Tools, Inc., Lafayette, LA, 2003, 1 page.

Non-Final Office Action dated Sep. 13, 2012, U.S. Appl. No. 12/756,177, filed Apr. 8, 2010, pp. 1-9.

Final Office Action dated Feb. 1, 2013, U.S. Appl. No. 12/756,177, filed Apr. 8, 2010, pp. 1-12.

Non-Final Office Action dated Aug. 14, 2013, U.S. Appl. No. 12/756,177, filed Apr. 8, 2010, pp. 1-11.

Final Office Action dated Mar. 13, 2014, U.S. Appl. No. 12/756,177, filed Apr. 8, 2010, pp. 1-11.

Jean Buytaert et al., "Multi-Vane Centralizer and Method of Forming", U.S. Appl. No. 14/461,282, filed Aug. 15, 2014.

Jean Buytaert et al., "Wrap-Around Band Tool Connector and Method of Forming", U.S. Appl. No. 14/461,292, filed Aug. 15, 2014.

Brent James Lirette et al., "Wrap Around Band and Sleeve Attachment Apparatus for an Oilfield Tubular", U.S. Appl. No. 14/461,297, filed Aug. 15, 2014.

International Search Report and Written Opinion dated Nov. 26, 2014 from International Application No. PCT/US2014/051358, pp. 1-9.

Jong Kyung Lee (Authorized Officer), International Search Report and Written Opinion dated Nov. 20, 2014, International Application No. PCT/US2014/051364, filed Aug. 15, 2014, pp. 1-16.

* cited by examiner

WRAP-AROUND STOP COLLAR AND METHOD OF FORMING

CROSS-REFERENCE TO RELATED APPLICATIONS

This application claims priority to U.S. Provisional Patent Application having Ser. No. 61/867,023, which was filed on Aug. 17, 2013. The entirety of this provisional application is incorporated herein by reference.

BACKGROUND

Oilfield tubulars, such as pipes, drill strings, casing, tubing, etc., may be used to transport fluids or to produce water, oil, and/or gas from geologic formations through wellbores. In various applications, a shoulder may be formed on an exterior of the tubular, e.g., for gripping the tubular and/or for connecting tools, such as centralizers, scrapers, cement baskets, etc. to the exterior of the tubular.

A variety of structures are employed to provide such shoulders. In some cases, integral parts of the tubular itself, such as expanded diameter sections, e.g., pipe joints at an end of the tubular, may be employed as the shoulder. In other cases, especially when a shoulder is needed between the ends of the tubular, a separate stop collar is generally fixed in position around the tubular to provide the shoulder. Such stop collars generally include a metal ring, which is either slid over an end of the tubular or hinged so as to receive the tubular laterally.

To fix the position of the stop collar on the tubular, the stop collars generally employ a gripping feature that engages the tubular. Such gripping features often include adhesives and/or marking structures, such as teeth or set screws. However, for some tubulars and/or applications thereof, marking the tubular may not be appropriate, either because marking the tubular damages the tubular or is otherwise incompatible with the application, or because the tubular may be too hard for marking structures to adequately bite into the tubular, resulting in inadequate holding forces. Adhesives, although suitable in a variety of stop collar applications, may lack sufficient durability or bonding strength to alone provide sufficient holding force.

SUMMARY

Embodiments of the disclosure may provide a stop collar for a tubular. The stop collar includes a flexible member extending circumferentially around the tubular more than once. A tension force on the flexible member causes the flexible member to apply a radially-inward gripping force on the tubular. The stop collar may also include a shield disposed around at least a portion of the flexible member, to protect the flexible member in a downhole environment.

Embodiments of the disclosure may also provide a method for installing a stop collar on a tubular. The method includes wrapping a flexible member more than once around a tubular, and applying a tension to the flexible member such that the flexible member applies a radially-inward gripping force on the tubular.

Embodiments of the disclosure may further provide an apparatus for securing to a tubular. The apparatus includes a helical flexible member positioned around a tubular, such that the flexible member applies a radially-inward gripping force on the tubular. The flexible member defines a plurality of turns around the tubular that are adjacent in a direction that is parallel to a central axis of the tubular. The apparatus also includes a layer of adhesive interposed between at least a portion of the flexible member and the tubular.

BRIEF DESCRIPTION OF THE DRAWINGS

The invention may best be understood by referring to the following description and accompanying drawings that are used to illustrate embodiments of the invention. In the drawings.

DETAILED DESCRIPTION

Figure 1A:
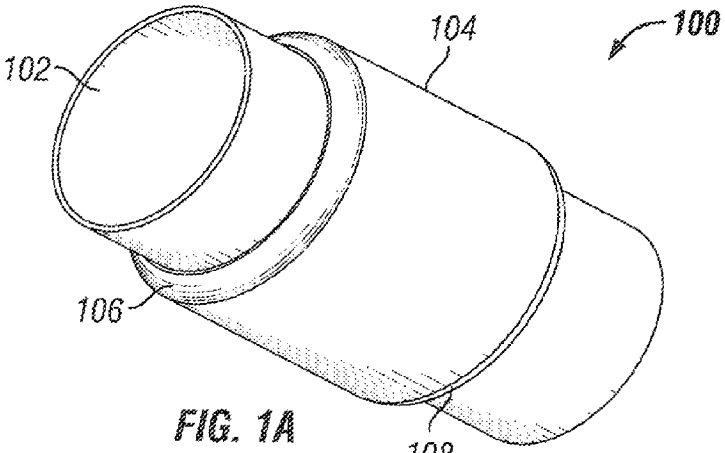
FIG. 1A illustrates a perspective view of a stop collar installed on a tubular, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

Figure 1C:
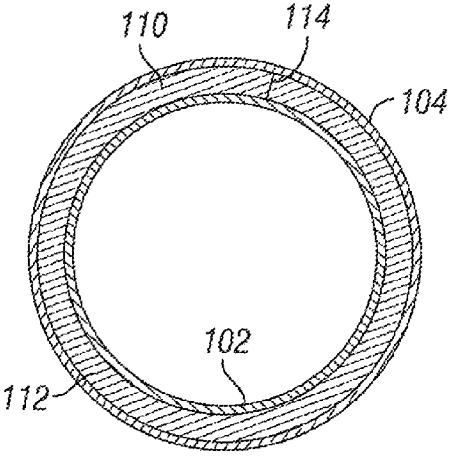
FIG. 1C illustrates an end view, taken along line 1C-1C in FIG. 1B, of the stop collar, according to an embodiment.
Figure 1B:
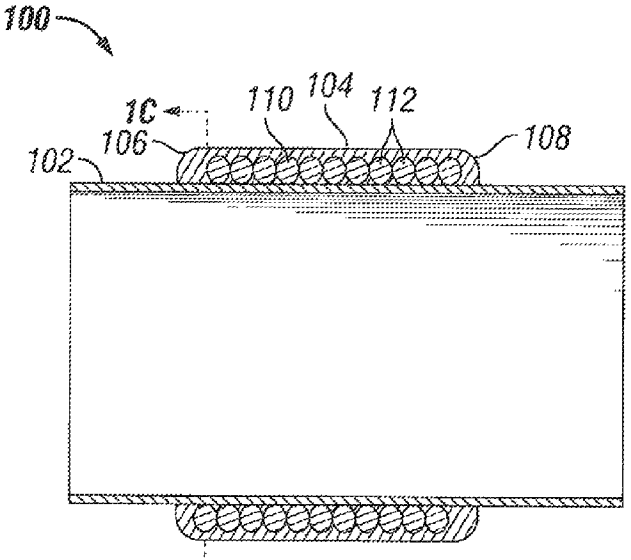
FIG. 1B illustrates a side, cross-sectional view of the stop collar installed on the tubular, according to an embodiment.

FIGS. 1A and 1B illustrate a perspective view and a side, cross-sectional view, respectively, of a stop collar 100 installed on an oilfield tubular 102, according to an embodiment. As the term is used herein, an "oilfield tubular" includes a pipe, tubular, tubular member, casing, liner, tubing, drill pipe, drill string, a bar, a rod, a structural member and other like terms. Such oilfield tubulars may be or include one or more segments, which may be connected or "made-up" together to form a stand or string; accordingly, an "oilfield tubular" may refer to a joint or segment of a tubular member, or a stand or string of multiple tubular members joined together. As used herein, "axial" and "axially" refer to a direction that is parallel to a central or longitudinal axis of the tubular 102; "radial" and "radially" refer to a direction perpendicular to the axial direction.

In particular, FIG. 1A illustrates the exterior of the stop collar 100, which may include a shield 104. The shield 104 may be or include an adhesive coating, and thus may also be referred to herein as a "coating." For example, the shield 104, e.g., when provided as an adhesive coating, may be or include an epoxy, glue, resin, polyurethane, cyanoacrylate, acrylic polymer, hot melt adhesive, contact adhesive, reactive adhesive, light curing adhesive, low temperature metal spray, metal spray (such as WEARSOX® commercially available from Antelope Oil Tool & Mfg. Co., Houston, Tex.), combinations thereof, and/or the like.

In other embodiments, the shield 104 may be or include a plastic, composite, metallic, etc. member, that may be disposed at least partially around the flexible member 110. The shield 104 may be selected, for example, so as to exhibit material properties suitable for exposure to the downhole environment and running-in along with the tubular 102. Such material properties may include low friction, high strength, and/or the like. Further, the stop collar 100 may have two axial ends 106, 108, which may, in at least one embodiment, be defined by the shield 104, as shown. One or both of the axial ends 106, 108 may extend straight in a radial direction from the tubular 102 and/or may be tapered, beveled, rounded, or otherwise shaped.

Further, the shield 104 may extend entirely over the stop collar 100, as shown, may extend partially thereabout, and/or may or may not extend radially inward into contact with the tubular 102. In some embodiments, a plastic, elastomeric, composite, metallic, etc. sleeve may be positioned over the shield 104, e.g., with the shield 104 providing an adhesive coupling the sleeve to a remainder of the stop collar 100.

Referring now specifically to FIG. 1B, the stop collar 100 may include a flexible member 110, which may be disposed radially between the tubular 102 and at least a portion of the shield 104. For example, the flexible member 110 may be wrapped more than once (e.g., one 360 degree turn plus any fraction of a subsequent turn) around the tubular 102. The flexible member 110 may apply a radially-inward gripping force on the tubular 102. For example, the flexible member 110 may be wrapped helically around the tubular 102, with the gripping force being generated by applying a tension on the flexible member 110 during such helical wrapping. In another embodiment, the flexible member 110 may be heated before, while, or after being wrapped around the tubular to or near to a red-hot transition temperature, which may cause the flexible member 110 to shrink, resulting in a tension force in the flexible member 110 that causes the flexible member 110 to apply a radially-inward gripping force on the tubular 102. Thereafter, the flexible member 110 may be cooled such that the flexible member 110 retains its shrunken length, thereby maintaining the radially-inward gripping force.

In such a helically-wrapped embodiment of the flexible member 110, the flexible member 110 may define turns 112 (e.g., 360 degree increments) around the tubular 102. Successive turns 112 may be adjacent to one another, generally in an axial direction along the tubular 102. In one, some, or all of the turns 112, the flexible member 110 may abut the flexible member 110 contained in at least one adjacent turn 112. As such, the flexible member 110 may form a generally continuous surface that is spaced radially apart from the tubular 102.

The shield 104 may be positioned (e.g., applied) at least partially on the exterior (radial outside, facing away from the tubular 102) of the flexible member 110, so as to protect the flexible member in the downhole environment. When provided as an adhesive coating, for example, the shield 104 may be rolled, brushed, or otherwise applied to the flexible member 110. In some embodiments, the shield 104 may be applied such that it extends axially past the first and last turns 112, so as to form the ends 106, 108, as noted above and shown in FIG. 1B. As such, the flexible member 110 may be at least partially embedded in the shield 104.

Furthermore, in at least one embodiment, an adhesive, which may or may not be formed from the same material as the shield 104, may be positioned radially between the flexible member 110 and the tubular 102, as will be described in greater detail below. In addition, the shield 104 may extend radially past (or through) the flexible member 110, between the ends 106, 108, and into engagement with the tubular 102. For example, the shield 104 may extend through spaces defined between the turns 112. Additionally or alternatively, holes may be formed in the flexible member 110, so as to allow traversal of the flexible member 110 by the shield 104.

The flexible member 110 may be an elongate member, which may be or include a monolithic or braided cable, wire, ribbon, string, cord, line, rope, band, tape, coil spring, multi-strand wire, wire rope and any member having the flexibility and strength to be wrapped about the outer surface of the tubular 102. For example, the flexible member 110 may constructed from a metal, plastic, composite, or any combination thereof. In one embodiment, the flexible member 110 includes a steel cable, e.g., a stainless steel cable. Further, the flexible member 110 may be one unitary length of material, e.g., a length providing a desired holding force once it is wrapped (and/or adhered) on the oilfield tubular. In other embodiments, the flexible member 110 may include multiple segments that are attached together (e.g., end-on-end).

FIG. 1C illustrates an axial end view of the flexible member 110 disposed around the tubular 102, according to an embodiment, e.g., as taken along lines 1C-1C of FIG. 1B. As shown, the flexible member 110 may include ends 114, e.g., one at the beginning of the first turn 112 proximal the first end 106. It will be appreciated that an axial view of the flexible member 110 proximal the second end 108 may be substantially similar, also providing a circumferential end where the flexible member 110 terminates. The ends 114 may be cut at angles, such that the ends 114 taper, and thereby provide a generally flush or gradual change in the end surface for the flexible member 110.

FIGS. 2A-2E illustrate an installation sequence for the stop collar 100, according to an embodiment. Beginning with FIG. 2A, installation collars 200, 202 may be positioned on the tubular 102 and spaced axially apart, e.g., such that the inboard sides 204, 206, respectively, of the collars 200, 202 are positioned generally where the ends 106, 108 (FIGS. 1A and 1B) of the stop collar 100 will be positioned. In some embodiments, such installation collars 200, 202 may be omitted from use during installation. In an embodiment, the installation collars 200, 202 may be each be provided by a unitary ring that may be slid over an end of the tubular 102. In another embodiment, the installation collars 200, 202 may be provided by a unitary ring that is flexible and includes an axially-extending gap, such that two circumferential ends are defined. In such an embodiment, the installation collars 200, 202 may be flexed so as to receive the tubular 102 laterally. In another embodiment, the installation collars 200, 202 may be provided by two or more arcuate sections that are connected together (e.g., hinged, clamped, fastened, etc.). It will be appreciated that in some embodiments, one of the installation collars 200 may be provided by one of the embodiments just described, while the other one of the installation collars 202 may be provided according to another embodiment.

Further, a layer 208 may be applied to the tubular 102, e.g., at least partially between the inboard sides 204, 206 of the collars 200, 202. The layer 208 may be or include an adhesive, such as an epoxy, glue, resin, polyurethane, cyanoacrylate, acrylic polymer, hot melt adhesive, contact adhesive, reactive adhesive, light curing adhesive, low temperature metal spray, metal spray (such as WEARSOX®), combinations thereof, and/or the like. The layer 208 may be employed to increase the holding force provided by the stop collar 100, avoid the flexible member 110 biting into the tubular 102, and/or the like. The layer 208 may coat the tubular 102 entirely between the installation collars 200, 202 or, in other embodiments, may include axially and/or circumferentially-extending gaps.

Before or after the layer 208 is cured (e.g., when using an adhesive for the layer 208), a first turn 112 of the flexible member 110 may be disposed around the tubular 102, between the installation collars 200, 202, e.g., proximal to the installation collar 200, and on the layer 208. The first turn 112 may include the end 114-1 of the flexible member 110. Further, the end 114-1 may be secured in place, such that it is generally stationary relative to the tubular 102 during installation. For example, the end 114-1 may be held in place, with tension applied to the flexible member 110, and the end 114-1 welded to a second turn 112 of the flexible member 110. In other embodiments, the flexible member 110 may be adhered to itself near the end 114-1, clamped or fastened to itself, or the like. In other embodiments, the end 114-1 of the flexible member 110 may be secured to the installation collar 200, which may be secured against rotation. In other embodiments, a section of the flexible member 110 proximal to the end 114-1 may be turned, e.g., toward an axial direction, and held temporarily in place while one or more additional turns 112 of the flexible member 110 are received over the end 114-1.

Figure 2A:
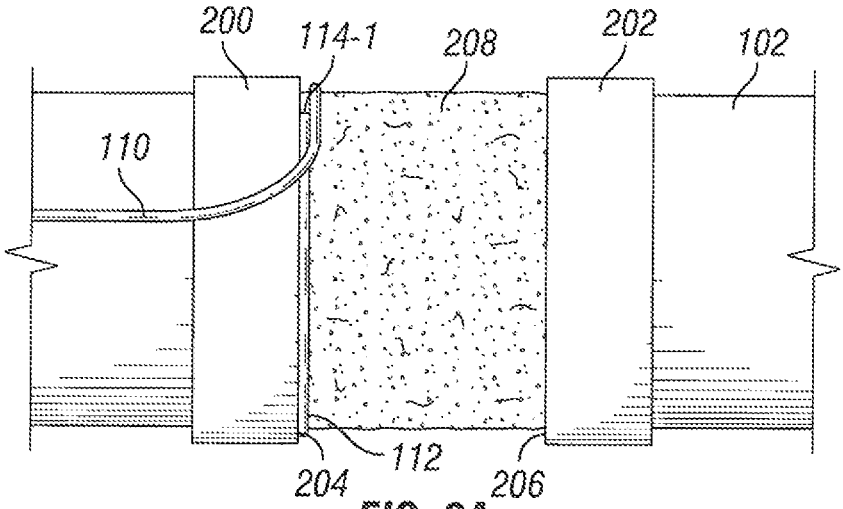
FIGS. 2A-E illustrate side views of an installation of the stop collar onto the tubular, according to an embodiment.
Figure 2B:
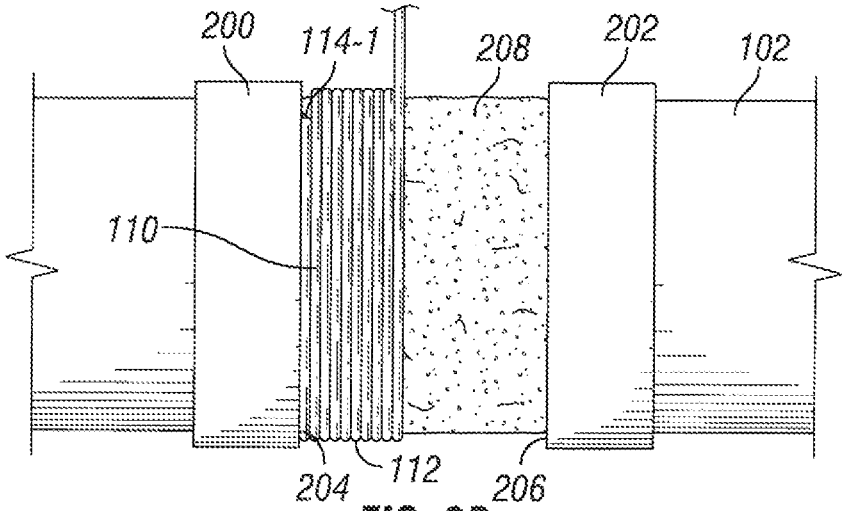

Referring now to FIG. 2B, the flexible member 110 may be helically wrapped around the tubular 102, e.g., as successive turns 112 are provided. In an embodiment, the tubular 102 may be turned while the flexible member 110 is fed laterally onto the tubular 102, e.g., from a spool. A friction or resistance (e.g., as applied by the spool of the flexible member 110 resisting the extension of the flexible member 10) may apply tension to the flexible member 110, causing the flexible member 110 to apply a radially-inwardly directed gripping force on the tubular 102. Thus, the gripping force supplied by the flexible member 110 may provide the holding force for the stop collar 100, once installed. In another embodiment, the tubular 102 may remain stationary while the flexible member 110 is wrapped therearound. In yet another embodiment, the tubular 102 may rotate and the flexible member 110 may be moved around the tubular 102, e.g., such that both components are in motion during the installation process. As shown, the successive turns 112 may abut against one another, however, in other embodiments, two or more of the adjacent turns 112 may be spaced apart, such that they do not abut.

In some embodiments, applying the layer 208 and wrapping the flexible member 110 may be an iterative process. For example, a certain width, e.g., less than the distance between the installation collars 200, 202, of the layer 208 may be applied onto the tubular 102, and then the flexible member 110 may be wrapped over that width of the layer 208. Then, another width of the layer 208 may be applied, and then flexible member 110 wrapped over that width. This process may repeat one or more times. In other embodiments, the layer 208 may be applied to the extent needed (e.g., all or a portion of the width between the installation collars 200, 202), and then the flexible member 110 may be wrapped around the tubular 102 continuously.

Figure 2C:
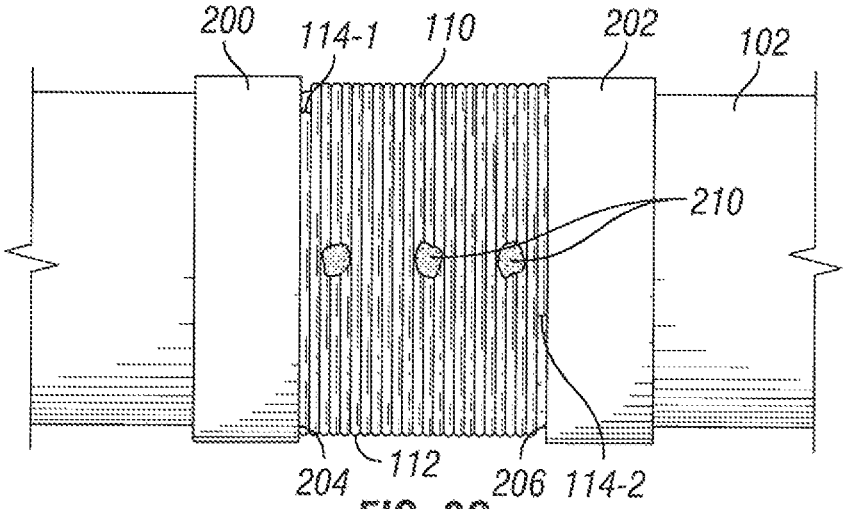

As shown in FIG. 2C, the helical wrapping of the flexible member 110 around the tubular 102 may continue, e.g., until the flexible member 110 abuts both of the installation collars 200, 202. In some embodiments, the wrapping of the flexible member 110 end prior to the flexible member 110 spanning the entire distance between the installation collars 200, 202.

In addition, in at least some embodiments, two or more adjacent turns 112 may be welded, adhered, or otherwise secured together. For example, as shown, several welds 210 may be created, attaching together the turns 112. Such welding (and/or otherwise attaching) together the turns 112 may further serve to retain the position of the flexible member 110.

Figure 2D:
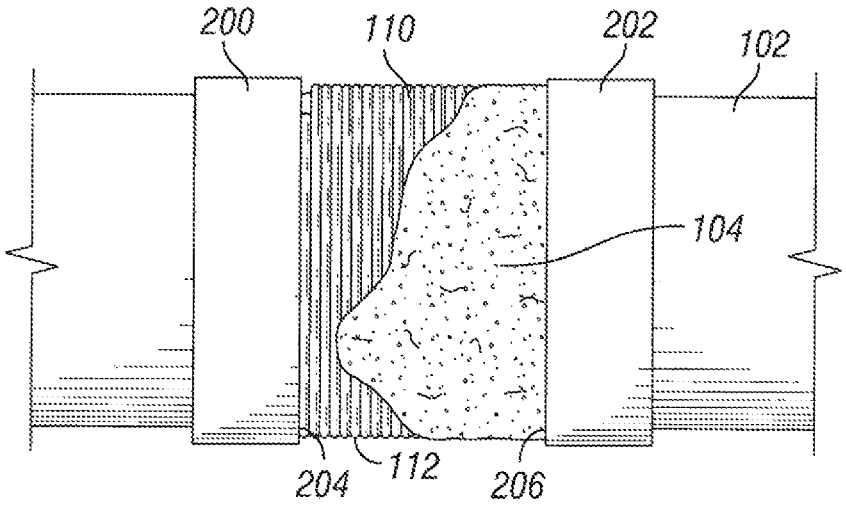

Referring to FIG. 2D, with the flexible member 110 in place, the shield 104 may be positioned (e.g., applied) around the flexible member 110. As noted above with reference to FIGS. 1A-1C, the shield 104 may be or include an adhesive, spray metal, and/or the like. The shield 104 may be deposited between the installation collars 200, 202. The radial height of the installation collars 200, 202 may be approximately equal to, or greater than, the thickness of the flexible member 110. Accordingly, the installation collars 200, 202 may act similar to the sides of a mold, keeping the shield 104 on the flexible member 110, and forming the ends 106, 108.

In some embodiments, e.g., due to the helical shape of the flexible member 110, a space may be defined between the ends of the flexible member 110 and the inboard sides 204, 206 of the installation collars 200, 202. This space may be filled with the shield 104, so as to provide the axial ends 106, 108 with a generally annular shape. Further, in some cases, the ends of the flexible member 110 may not contact the collars 200, 202, and thus the shield 104 may extend past the flexible member 110 and define the ends 106, 108, e.g., as shown in FIG. 1B.

In at least one embodiment, a shell may be placed around the flexible member 110 and/or the shield 104. The shell may have an outer surface that is planar or outwardly-curved (e.g., convex), and the inner surface of the shell may include a plurality of projections, curved ridges, a fish scale pattern, or the like. The shell may be structurally reinforced with a strut, a brace, a rib, or the like that extends between two opposite sides of the shell. The shell may be formed from a composite material (e.g., a fiber-reinforced resin material), which may be surface-treated before molding of the shell. The shell may have at least one inlet configured to receive a liquid material such as a bonding agent. The bonding agent may be used to couple the shell to the outer surface of the tubular and the flexible members. The flexible member may provide support to the shell. Additional details of the shell may be found in PCT Application No. PCT/EP2013/057416, filed Apr. 9, 2013, which is hereby incorporated by reference in its entirety.

Figure 2E:
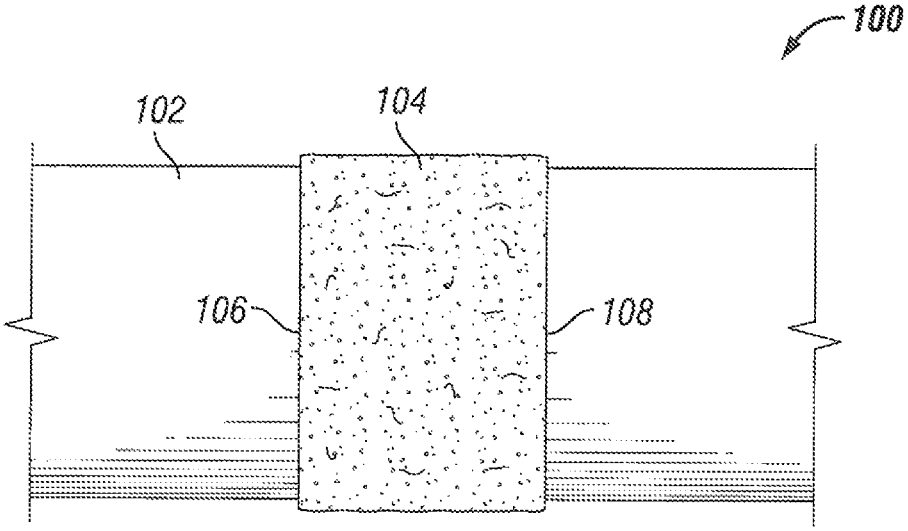

Referring to FIG. 2E, once the shield 104 is applied, the installation collars 200, 202 may be removed from the tubular 102, e.g., by sliding the installation collars 200, 202 over opposite ends of the tubular 102 or by removing one or more of the installation collars 200, 202 laterally, e.g., by opening a hinge. The remaining structure may generally provide the stop collar 100, according to an embodiment. In some cases, further forming, e.g., to taper, round, smooth, roughen, or otherwise shape the ends 106, 108 and/or the outer diameter of the shield 104, may be conducted. Further, a sleeve or any other structure may be coupled with the shield 104 and/or to the flexible member 110.

Although described above with reference to a relatively thin (in axial dimension and relative to the total axial width of the stop collar 100) flexible member 110, it will be appreciated that the flexible member 110 may have a larger axial width, up to a width that equals the axial dimension, from end 106 to end 108, of the stop collar 100. For example, rather than helically wrapping the flexible member 110 around the tubular 102, each turn of the tubular 102 with respect to the flexible member 110 (either the tubular 102 or the flexible member 110 may be moving, as described above) may result in a complete layer of the flexible member 110 being deposited. Thus, as will be described below, multiple layers of the flexible member 110 may be wrapped around the tubular 102, e.g., in concentric layers.

Figure 3A:
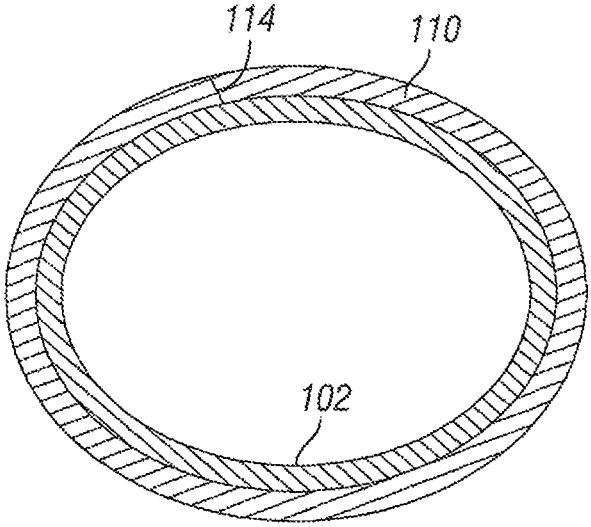
FIGS. 3A and 3B illustrate axial end, cross-sectional views of the flexible member of the stop collar, disposed around the tubular, according to an embodiment.
Figure 3B:
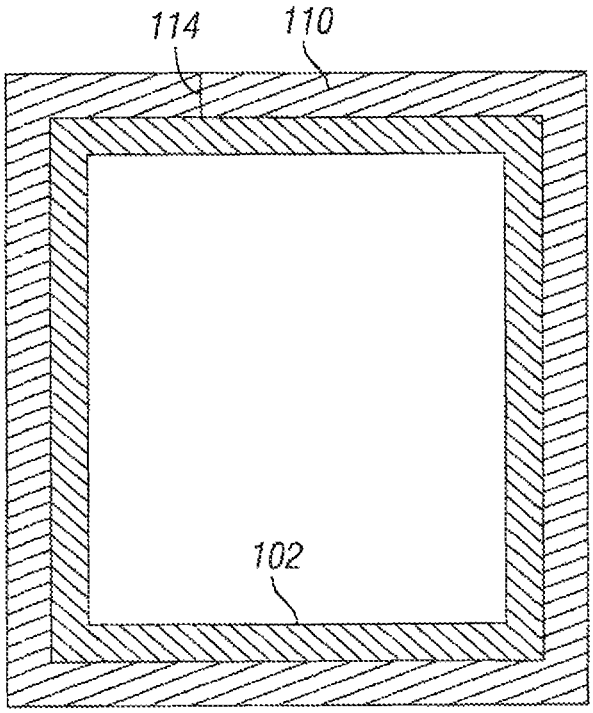

FIGS. 3A and 3B illustrate two axial, cross-sectional views of the flexible member 110, similar to the view shown in FIG. 1C, according to two embodiments. As depicted in FIG. 3A, in some instances, the tubular 102 may be generally elliptical, rather than circular. The flexible member 110 may, however, be configured to wrap around such a non-circular geometry. Similarly, as shown in FIG. 3B, the tubular 102 may be polygonal, e.g., rectangular, in shape, and the flexible member 110 may be disposed along the perimeter of the tubular 102. Accordingly, embodiments of the stop collar 100 may be configured to be disposed around any shape.

Figure 4:
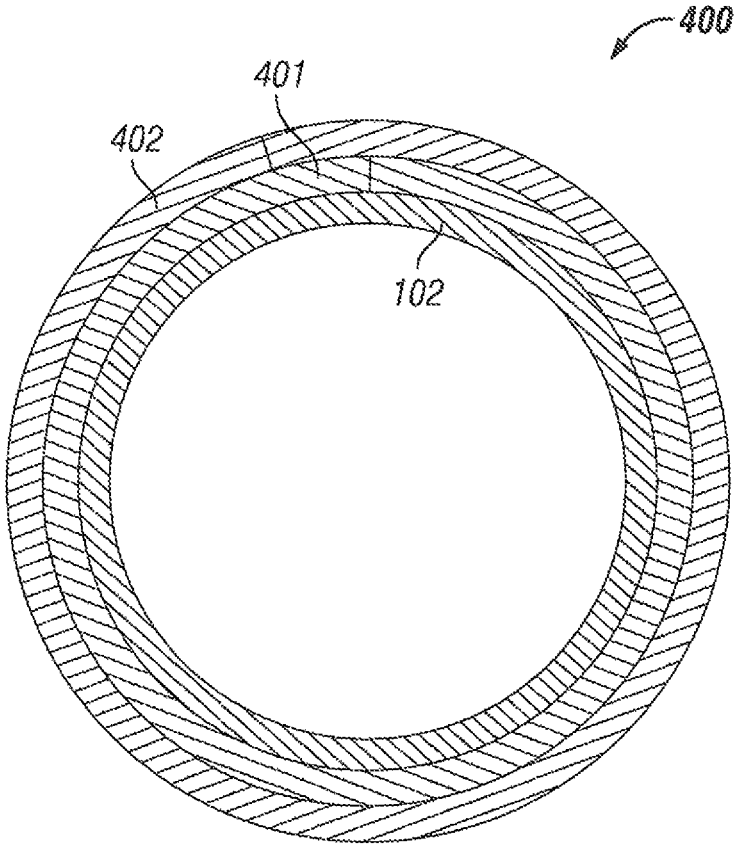
FIG. 4 illustrates an axial end, cross-sectional view of a multi-layered flexible member of the stop collar disposed around the tubular, according to several embodiments.

FIG. 4 illustrates an axial end-view of a multi-layered flexible member 400, according to an embodiment. The multi-layered flexible member 400 may include at least two layers 401, 402. In an embodiment, the flexible member 110 may provide the first layer 401, which may, as discussed above, be disposed against the tubular 102. In addition, the second layer 402 may be disposed radially outward from the first layer 401, e.g., provided as a second flexible member that is wrapped around the flexible member 110. The second layer 402 may be wrapped around at least a portion of the flexible member 110, e.g., using an embodiment of the wrapping process discussed above with respect to FIGS. 2A-2E. Any number of layers 401, 402 may be provided, e.g., so as to achieve a desired positive outer diameter (e.g., the radial distance added by the provision of the stop collar 100 extending from the tubular 102), which may be larger than a thickness of the flexible member 110.

Further, in some embodiments, the first and second layers 401, 402 may have differently-shaped cross-sections. For example, the first layer 401 may have a circular cross-section, while the second layer 402 may have a braided cross-section. Any other combination of cross-sections may be provided for the first and second layers 401, 402, whether the same or different.

In another embodiment, the flexible member 110 may provide both of the first and second layers 401, 402. For example, in an embodiment in which the flexible member 110 is a relatively thin (relative to the axial length of the stop collar 100), helically-wrapped member, the first layer 401 may be constructed by wrapping the flexible member 110 around the tubular 102, and then the wrapping direction may be reversed, with the second layer 402 of the flexible member 110 being wrapped around the first layer 401 thereof. In another embodiment, the flexible member 110 may have the same width as the stop collar, and thus each turn of the tubular 102 may provide an additional layer.

Figure 5:
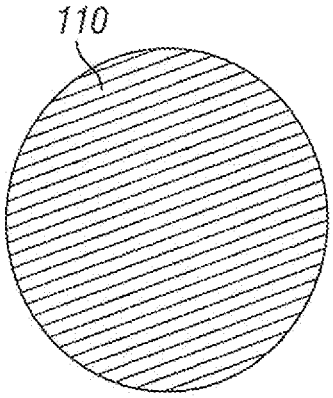
FIGS. 5-9 illustrate cross-sectional views of the flexible member, according to several embodiments
Figure 6:
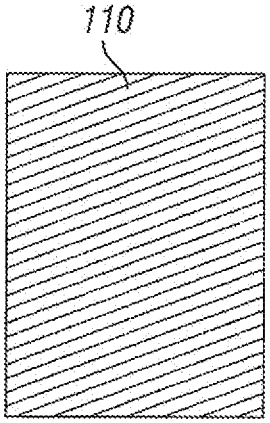
Figure 7:
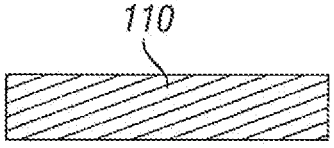
Figure 8:
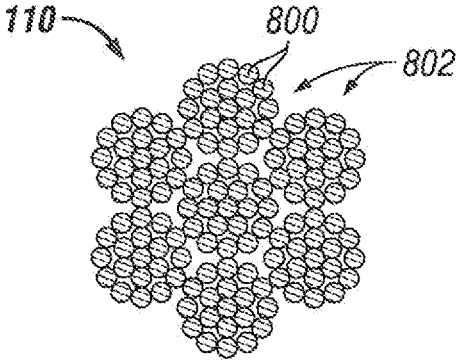

FIGS. 5-9 illustrate five example cross-sections for the flexible member 110. As shown in FIG. 5, the cross-section of the flexible member 110 may be generally circular, e.g., as with a solid wire or other flexible cylindrical structure. FIG. 6 illustrates a square-shaped cross-section, and FIG. 7 similarly illustrates a rectangular-shaped cross-section, which may be provided in an embodiment in which the flexible member 110 is formed as a band. FIG. 8 illustrates a more complex cross-section for the flexible member 110, which may be made of a plurality of filaments 800. The filaments 800 may be braided or otherwise combined into strands 802, which may in turn be braided or otherwise combined to form the cross-section of the flexible member 110. Although seven strands 802 are illustrated, any number of strands 802 may be employed, each of which may be constructed using any number of filaments 800.

Figure 9:
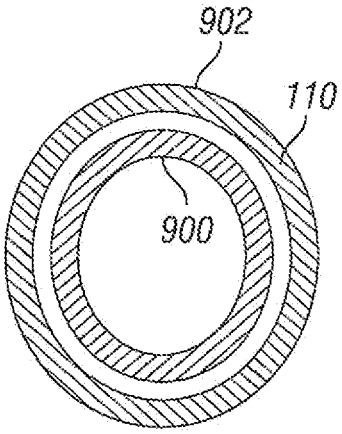

Moreover, as depicted in FIG. 9, the flexible member 110 may be constructed from two or more bodies. For example, the flexible member 110 may include a mandrel 900 and a sheath 902, which may be generally concentric. The mandrel 900 may have any shape cross-section and may be solid, hollow, or formed from a combination of filaments, strands, etc. The sheath 902 may fit over and/or around the mandrel 900. The mandrel 900 may be attached to the sheath 902, but in other embodiments may be movable therein.

Figure 10:
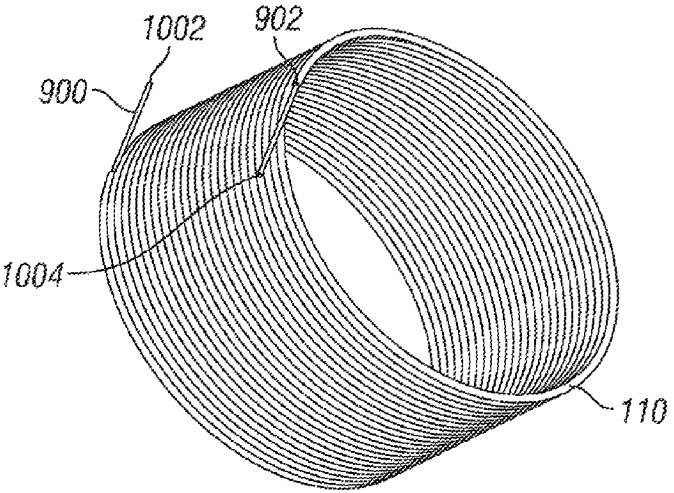
FIG. 10 illustrates a perspective view of a pre-coiled flexible member of the stop collar, according to an embodiment.

Still referring to FIG. 9, FIG. 10 illustrates a perspective view of a pre-wound or pre-coiled flexible member 110 that includes the mandrel 900 and the sheath 902, according to an embodiment. The flexible member 110 may be pre-wound in that it is formed into the illustrated helix prior to installation around a tubular (e.g., the tubular 102 shown in FIG. 1A).

Further, ends 1002, 1004 of the mandrel 900 may extend from the sheath 902. In a pre-coiled embodiment, the coil of flexible member 110 may initially have an inner diameter that is larger than the outer diameter of the tubular (e.g., tubular 102), and may thus slide onto the tubular. Upon reaching an installation point, which may or may not include a layer of adhesive, such as the layer 208, a tension force may be applied to the ends 1002, 1004, thereby reducing the diameter of the mandrel 900. In some cases, at least initially, the sheath 902 may move with the mandrel 900, but may become engaged between the mandrel 900 and the tubular. Continued application of force on the ends 1002, 1004 may cause the mandrel 900 to move relative to the sheath 902, and the sheath 902 may be compressed between the tubular and the mandrel 900. In some embodiments, the sheath 902 may be made from a relatively soft material, such as a plastic, elastomer, or relatively soft metal, which may prevent the mandrel 900, which may be made of a harder material, from damaging the tubular during constriction of the mandrel 900.

In other embodiments, the flexible member 110 including the mandrel 900 and the sheath 902 may be wound as it is installed onto the tubular 102, for example, similar to the way in which the flexible member 110 is installed as shown in and described above with reference to FIGS. 2A-2E. In an embodiment, the flexible member 110 may be wrapped loosely around the tubular 102, and then the tension applied to the ends 1002, 1004, so as to contract the mandrel 900 and cause the flexible member 110 to grip the tubular.

Figure 11B:
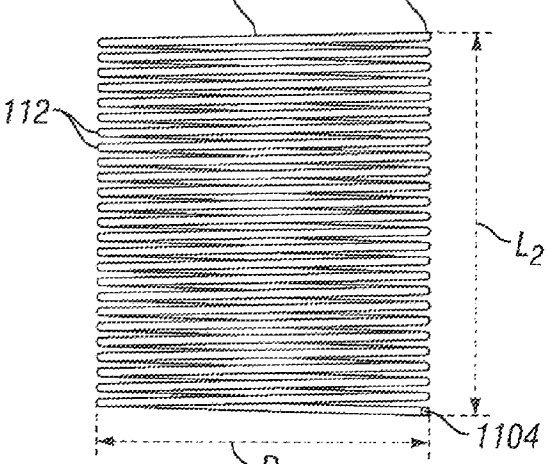
FIGS. 11A and 11B illustrate side views of a helical-spring embodiment of the flexible member.
Figure 11A:
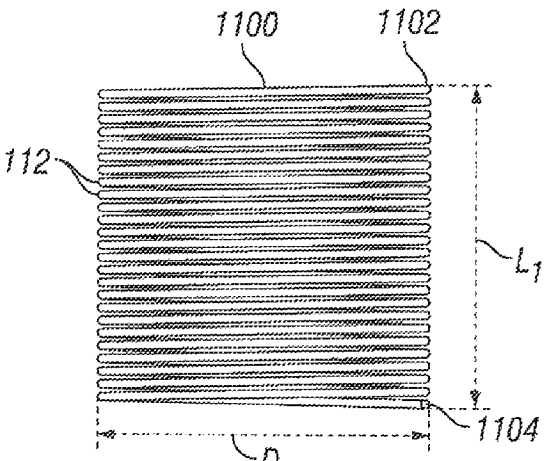

FIGS. 11A and 11B illustrate side views of another pre-wound, helical-spring embodiment of the flexible member 1100 for use in the stop collar 100. In particular, FIG. 11A shows the flexible member 1100 in a first or "natural" configuration, and FIG. 11B shows the flexible member 1100 in an expanded configuration. In an embodiment, the flexible member 1100 may be formed with a first or "natural" length $L_1$ and a first or "natural" diameter $D_1$, as shown in FIG. 11A. The natural length $L_1$ and natural diameter $D_1$ may be the length and diameter, respectively, that the helical spring of the flexible member 110 has when no external force is applied. The flexible member 1100 may also define a certain number of turns 112 in the natural configuration.

Prior to installing the flexible member 1100 onto the tubular, a torque force may be applied to the flexible member 1100, e.g., to the ends 1102, 1104 thereof. The torque force may serve to expand the flexible member 1100 at least to a second diameter $D_2$, e.g., by reducing the number of turns 112. Such torque may also create spaces between the turns 112, which may cause the length of the flexible member 1100 to increase to a second length $L_2$. The flexible member 1100 in the expanded configuration may be received over a tubular having a diameter that is between the first and second diameters $D_1$, $D_2$ of the flexible member 1100. Upon reaching a desired installation location, the torque force may be removed, causing the flexible member 1100 to contract. In another embodiment, a temporary adhesive may be employed to retain the flexible member 1100 in the expanded configuration for a duration, before breaking down and allowing the flexible member 1100 to contract. Full contraction to the first, natural diameter $D_1$ may be prevented by the flexible member 1100 bearing on the tubular, and thus the flexible member 1100 may apply a spring force on the tubular, which may provide the gripping/holding force.

Figure 12A:
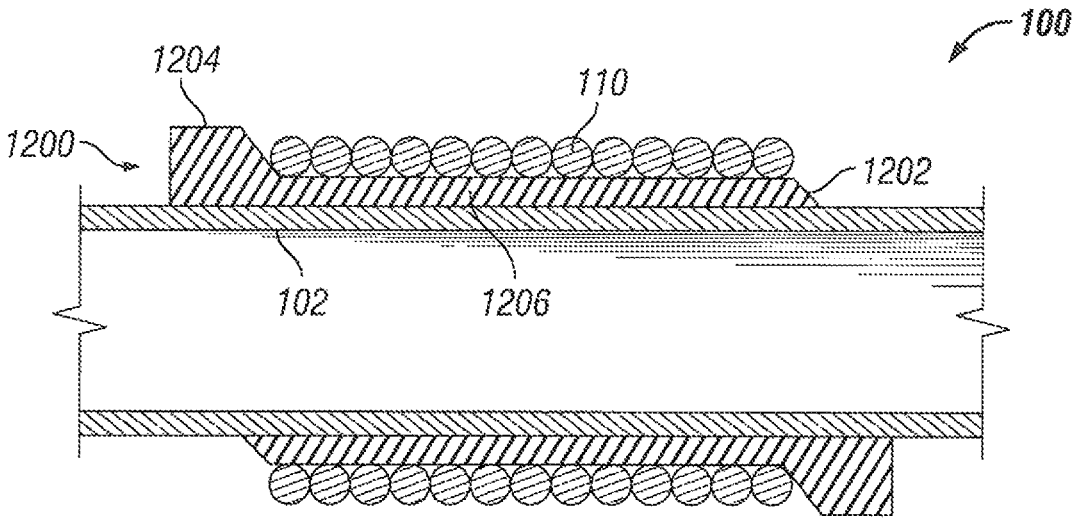
FIG. 12A illustrates a side cross-sectional view of a stop collar including an insert disposed between the flexible member and the tubular, according to an embodiment.
Figure 12B:
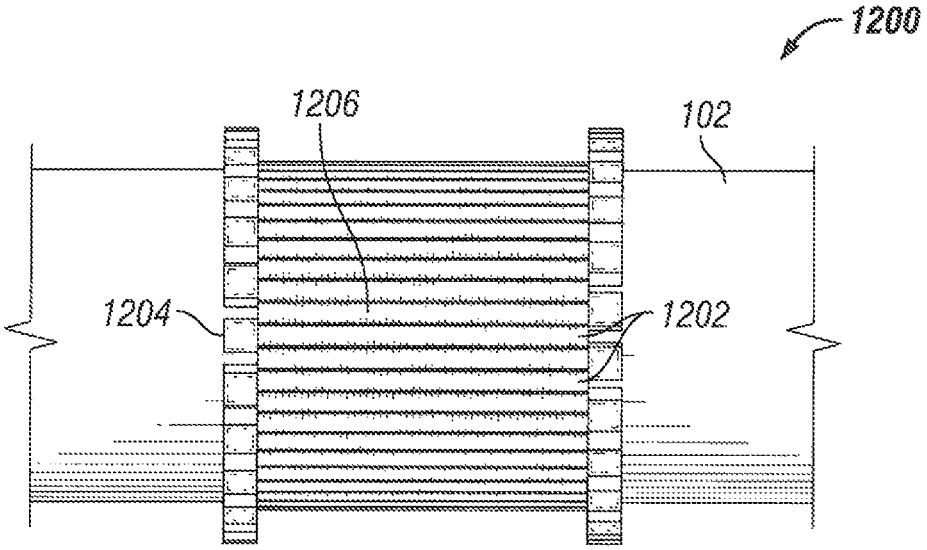
FIG. 12B illustrates a side perspective view of the insert disposed around the tubular, according to an embodiment.

FIG. 12A illustrates a side, cross-sectional view of the stop collar 100 including an insert 1200, according to an embodiment. FIG. 12B illustrates a side view of the insert 1200, with the remainder of the stop collar 100 omitted for purposes of illustration. The insert 1200 (which may also be referred to as a "spline") may be formed from a plurality of segments 1202. Each segment 1202 may include a head 1204 and an elongate body 1206. The segments 1202 may be disposed in an alternating orientation, such that the head 1204 of one segment 1202 is disposed at an axially opposite side to the head 1204 of an adjacent segment 1202, as shown. Thus, the elongate body 1206 of each segment 1202 may serve as a spacer between circumferentially-adjacent segments 1202. In other embodiments, each segment 1202 may include two heads 1204, e.g., one on each axial side thereof.

Further, the heads 1204 may extend radially outwards from the tubular 102, farther than the elongate bodies 1206. The heads 1204 may thus collectively define end rings on either side of the insert 1200, which may be engaged by a tool or another device disposed around the tubular 102, e.g., in the wellbore. For example, the combination of the elongate bodies 1206 and the flexible member 120 may extend to approximately the same radial position as the radial-outside of the heads 1204; however, in other embodiments, the heads 1204 may extend farther outwards than, or not as far outwards as, the flexible member 110 disposed on the elongate bodies 1206.

The segments 1202 may be connected together, e.g., using an elastic band received around the tubular 102. In another embodiment, the segments 1202 may be unitary, glued, snapped, hooked, or otherwise held together circumferentially, so as to facilitate installation around the tubular 102.

In operation, the insert 1200 may, as shown, be sandwiched between the flexible member 110 and the tubular 102. The insert 1200 may be fabricated at least partially from a material that is relatively soft compared to the tubular 102 and the flexible member 110. For example, the insert 1200 may be made from a molded plastic, an elastomer, another plastic, a composite, a relatively soft metal, etc. Thus, the insert 1200 may be compressed when the flexible member 110 is received around the tubular 102, and may provide a buffer between the flexible member 110 and the tubular 102, e.g., to reduce the risk of damaging the tubular 102, to increase holding forces (e.g., by providing a high-friction insert 1200 and/or by including teeth or other marking structures on an inner surface and/or outer surface of the insert 1200), and/or the like.

In at least one embodiment, the insert 1200 may contain an adhesive, which may be released upon compression of the insert 1200 by the flexible member 110. For example, the insert 1200 may include encapsulated pockets of adhesive therein, and may include holes or predetermined rupture locations. When the flexible member 110 provides a radially-inward gripping force, the adhesive may migrate out of the pockets and into contact with the flexible member 110, forming a bond between the flexible member 110 and the tubular 102 and/or the insert 1200.

Figure 13:
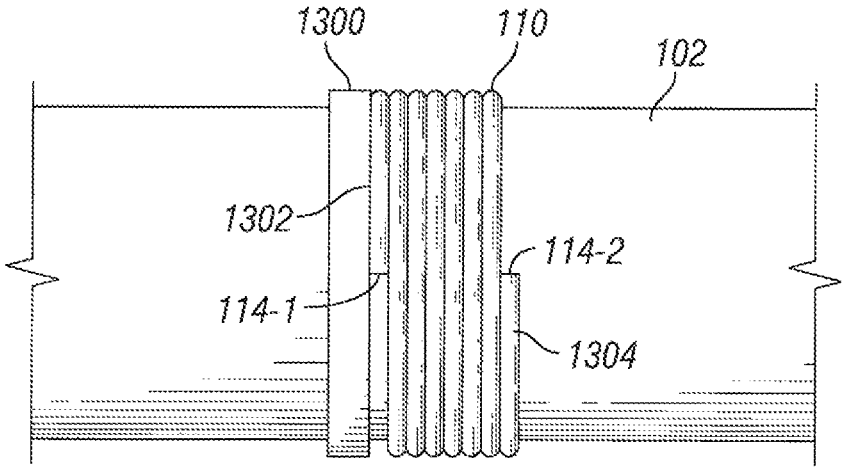
FIG. 13 illustrates a side perspective view of the flexible member and an engaging ring disposed adjacent thereto and around the tubular, according to an embodiment.

FIG. 13 illustrates a side view of the flexible member 110 and an engaging ring 1300 of the stop collar 100, according to an embodiment. The engaging ring 1300 may be made from an annular band of material, such as metal, plastic, elastomer, composite, etc. The engaging ring 1300 may be secured at least in an axial position by fixing the engaging ring 1300 to either or both of the tubular 102 and/or the flexible member 110, e.g., using adhesives, welding, set screws, etc. In other embodiments, the engaging ring 1300 may be free to move about and/or along the tubular 102, except as constrained by axial engagement with the flexible member 110 and any other collars or protrusions disposed on the tubular 102. Further, the engaging ring 1300 may be configured to bear upon, and thus transmit a generally axially-directed force against a side 1302 of the flexible member 110.

Accordingly, the engaging ring 1300 may provide a generally uniform, radially-extending surface against which tools, etc., may engage and push toward the flexible member 110. The engaging ring 1300 may thus be sandwiched between the flexible member 110 and the force-applying member (e.g., tool, component, etc.). As such, the flexible member 110 may continue providing the holding force, while the engaging ring 1300 may prevent the force-applying member from damage caused by engaging the end 114-1 of the helical, flexible member 110.

It will be appreciated that a second engaging ring may be provided, e.g., adjacent to the opposite axial side 1304 of the flexible member 110, e.g., to provide for engagement with a force-applying member in an opposite direction.

Figure 14:
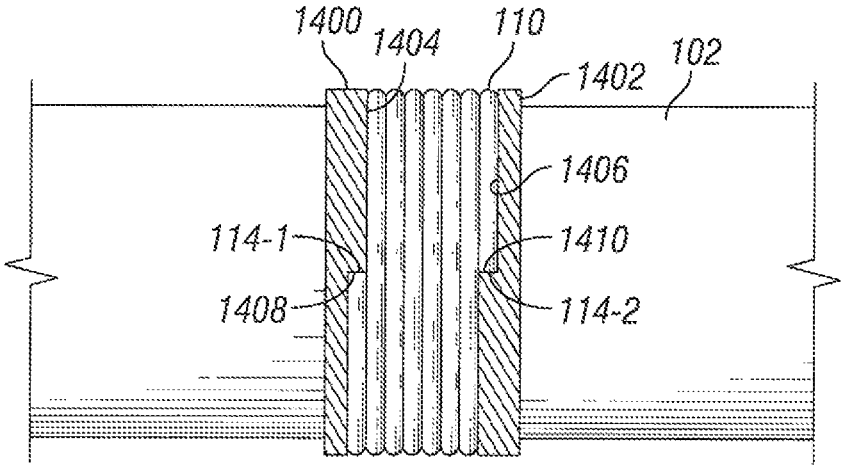
FIG. 14 illustrates a side perspective view of the flexible member and two profiled engaging rings disposed on opposite axial sides of the flexible member, according to an embodiment.

FIG. 14 illustrates a side view of two engaging rings 1400, 1402 on either axial side 1302, 1304 of a flexible member 110, according to an embodiment. The engaging rings 1400, 1402 may be generally similar in form and/or function to the engaging ring 1300 of FIG. 13; however, the engaging rings 1400, 1402 may include profiled inner surfaces 1404, 1406 that face in the axial direction. For example, the inner surface 1404, may begin at a certain thickness at a starting point, and decrease in thickness as proceeding circumferentially around the engaging ring 1400, until reaching the stating point, at which point the thickness may abruptly (or smoothly) return to the original thickness. The opposing engaging ring 1402 may be similarly constructed, but the profiled inner surface 1406 thereof may be a mirror image of the profiled inner surface 1404. That is, for example, the profiled inner surface 1406 may smoothly reduce in thickness from the starting point as proceeding clockwise, while the profiled inner surface 1404 may smoothly reduce in thickness from the starting point in a counterclockwise direction.

The profiled inner surfaces 1404, 1406 may thus define a shoulder 1408, 1410 at the starting points thereof. The shoulders 1408, 1410 may be configured to receive the ends 114-1, 114-2, respectively, of the flexible member 110, and the profiled inner surfaces 1404, 1406 may be configured to engage a maximum surface area of the flexible member 110 along the proximal turn 112.

Figure 15:
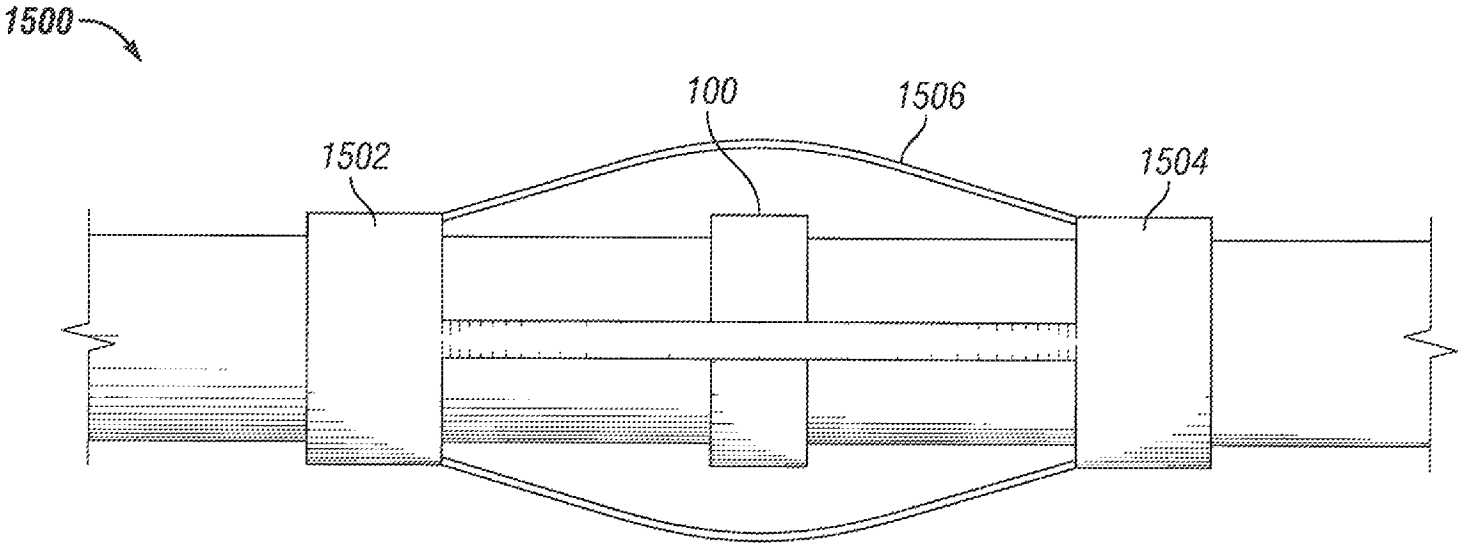
FIG. 15 illustrates a side, conceptual view of a stop collar and a centralizer disposed on the tubular, according to an embodiment.

FIG. 15 illustrates a side view of the stop collar 100 installed on the tubular 102 and straddled by a centralizer 1500, according to an embodiment. The centralizer 1500 may include two end collars 1502, 1504, which are received around the tubular 102 and separated axially apart. A plurality of ribs 1506, which may be rigid, semi-rigid, or flexible, bow-springs extend between the end collars 1502, 1504 and are disposed at circumferential intervals around the tubular 102. The ribs 1506 may extend radially outward from the tubular 102 and may be configured to engage a surrounding tubular (e.g., a casing, liner, or wellbore wall), so as to maintain a generally annular stand-off between the tubular 102 and the surrounding tubular 102.

As shown, the end collars 1502, 1504 may be disposed on opposite axial sides of the stop collar 100, i.e., in a "straddled" configuration. In this embodiment, the ribs 1506 extend over the stop collar 100. In addition, engaging members may be coupled with one or both of the end collars 1502, 1504 and the stop collar 100. In other embodiments, one or more stop collars 100 may be disposed on the outboard axial ends of the end collars 1502, 1504.

The end collars 1502, 1504 may bear on the stop collar 100, e.g., when passing through a wellbore restriction or otherwise experiencing axially-directed (e.g., drag) forces. The stop collar 100 may provide a holding force, which may retain the axial position of the centralizer 1500 with respect to the tubular 102.

Figure 16:
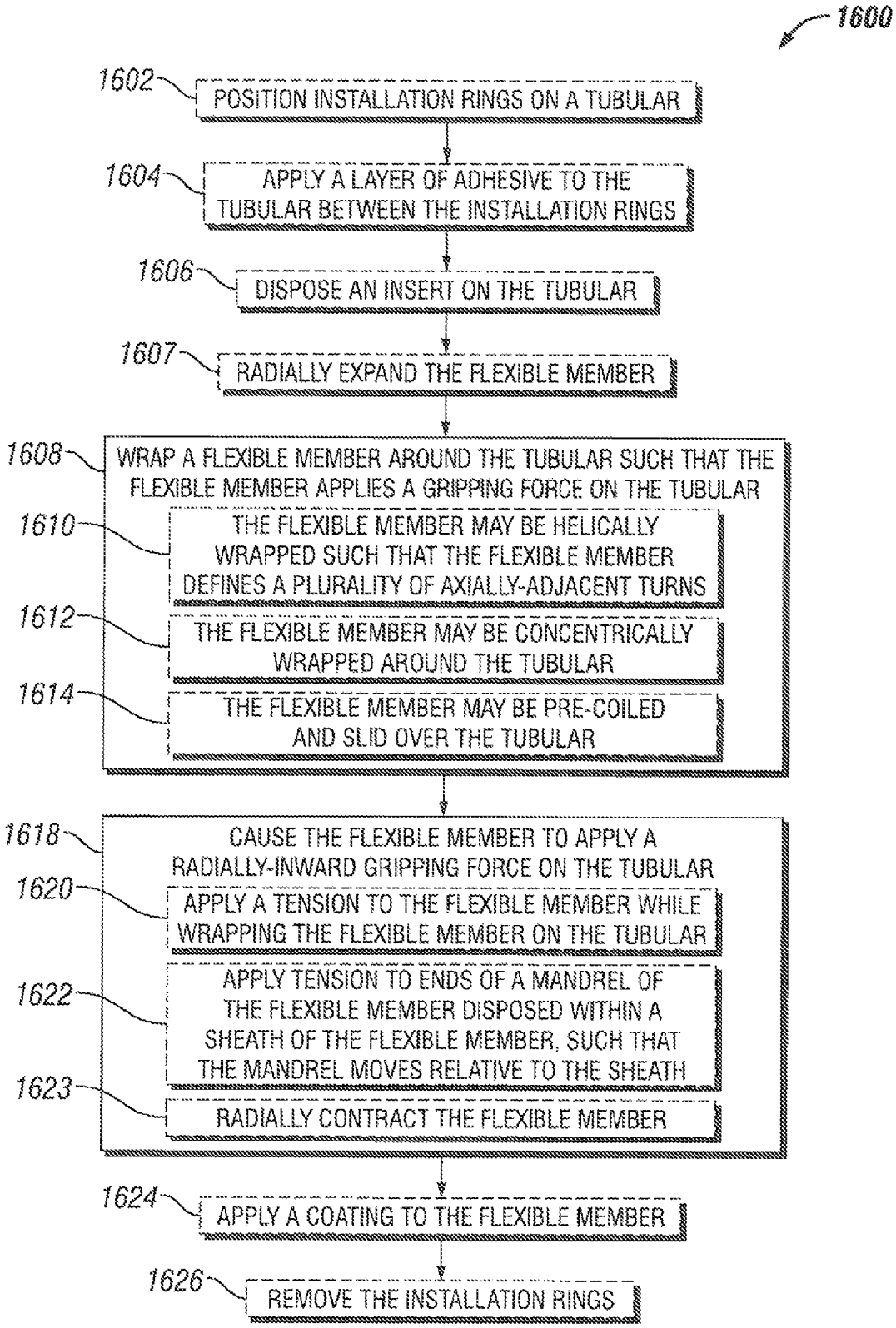
FIG. 16 illustrates a flowchart of a method for installing a stop collar on a tubular, according to an embodiment.

FIG. 16 illustrates a flowchart of a method 1600 for installing a stop collar on a tubular, according to an embodiment. The method 1600 may be best understood with reference to FIGS. 1-15; however, it will be appreciated that the method 1600 is not limited to any particular structure, unless otherwise specifically stated herein.

The method 1600 may include positioning installation rings on a tubular, as at 1602. Positioning the installation rings may occur by sliding the installation rings over an end of the tubular, or by opening or decoupling segments of the installation rings, so as to position the installation rings around the tubular. It will be appreciated that at least block 1602 (and at least blocks similarly indicated by dashed lines) are optional and may be omitted from embodiments of the method 1600.

The method 1600 may proceed to applying a layer of adhesive to the tubular, for example, between the installation rings (where provided), as at 1604. Further, in an embodiment, an insert, such as a spline, may be disposed on the tubular, as at 1606. At this point, a flexible member may be prepared for disposing around the tubular. In an embodiment, the flexible member may be radially expanded, for example, in embodiments in which the flexible member includes a helical spring, as at 1607.

The flexible member may be wrapped more than once around the tubular, as at 1608. For example, the flexible member may be helically wrapped around the tubular such that the flexible member defines a plurality of axially-adjacent turns, as at 1610. In such helical wrapping, an end of the flexible member may be fixed in position relative to the tubular, as at 1611, for example, the end of the flexible member (or a portion thereof proximal to the end) may be fixed to another portion of the flexible member. In an embodiment, the flexible member may be heated, such that it shrinks, during or after the winding process. In an embodiment, the flexible member may be concentrically wrapped around the tubular, as at 1612. Such helical and concentric embodiments may provide one or more radially adjacent layers of the flexible member.

The method 1600 may also include applying a tension to the flexible member such that the flexible member applies a radially-inward gripping force on the tubular, as at 1618. For example, the method 1600 may include applying the tension to the flexible member while wrapping the flexible member around the tubular, as at 1620. In another example, the method 1600 may include applying a tension to ends of a mandrel of the flexible member disposed within a sheath of the flexible member, such that the mandrel moves relative to the sheath, as at 1622. In another example, the method 1600 may include radially contracting the flexible member, as at 1623. The method 1600 may then proceed to applying a shield (e.g., a coating) to the flexible member, as at 1624, and removing the installation rings, as at 1626.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A stop collar for a tubular, comprising:

a flexible member extending circumferentially around the tubular more than once, wherein a tension force on the flexible member causes the flexible member to apply a radially-inward gripping force on the tubular;

an insert disposed at least radially between the flexible member and the tubular, wherein the insert comprises a plurality of segments that are circumferentially adjacent and each having an elongate body and a head, the heads of the plurality of segments forming one or more engaging rings axially adjacent to the flexible member; and a shield disposed around at least a portion of the flexible member, to protect the flexible member in a downhole environment.

2. The stop collar of claim 1, wherein the shield comprises an adhesive coating.

3. The stop collar of claim 1, wherein the flexible member is at least partially embedded in the shield.

4. The stop collar of claim 1, further comprising a layer of adhesive disposed radially between at least a portion of the flexible member and the tubular.

5. The stop collar of claim 4, wherein at least a portion of the layer of adhesive contacts the shield.

6. The stop collar of claim 1, wherein the flexible member comprises an elongate member that is helically wrapped around the tubular such that the flexible member defines a plurality of turns extending around the tubular.

7. The stop collar of claim 6, wherein a portion of the flexible member proximal to an end thereof is secured to an axially-adjacent portion of the flexible member, so as to maintain a position of a first turn of the plurality of turns.

8. The stop collar of claim 6, wherein at least one of the plurality of turns abuts at least another one of the plurality of turns.

9. The stop collar of claim 6, wherein the tension force is applied to the flexible member while it is being helically wrapped.

10. The stop collar of claim 1, wherein the flexible member is concentrically wrapped around the tubular.

11. The stop collar of claim 1, wherein the flexible member comprises a mandrel and a sheath, the mandrel being generally concentric with the sheath and movable with respect thereto.

12. The stop collar of claim 1, wherein the flexible member comprises a helical spring, wherein the helical spring has a natural diameter that is smaller than an outer diameter of the tubular, such that the helical spring applies the radially-inward gripping force on the tubular.

13. The stop collar of claim 1, wherein the stop collar is configured to be attached to or engage a downhole tool disposed at least partially around the tubular.

14. A method for installing a stop collar on a tubular, comprising:

wrapping a flexible member more than once around a tubular, wherein an insert is positioned at least radially between the flexible member and the tubular, and wherein the insert comprises a plurality of segments that are circumferentially adjacent and each having an elongate body and a head, the heads of the plurality of segments forming one or more engaging rings axially adjacent to the flexible member; and applying a tension to the flexible member such that the flexible member applies a radially-inward gripping force on the tubular.

15. The method of claim 14, wherein applying the tension to the flexible member comprises applying the tension to the flexible member during the wrapping of the flexible member around the tubular.

16. The method of claim 14, wherein wrapping the flexible member comprises helically wrapping the flexible member around the tubular, such that successive turns of the flexible member are axially adjacent to one another.

17. The method of claim 16, wherein the flexible member in one of the turns abuts the flexible member in another one of the turns.

18. The method of claim 16, further comprising connecting together at least two of the turns in a direction parallel to a central axis of the tubular.

19. The method of claim 14, further comprising fixing a position of an end of the flexible member with respect to the tubular prior to at least a portion of the wrapping of the flexible member around the tubular.

20. The method of claim 14, further comprising applying an adhesive to the tubular, wherein wrapping the flexible member comprises disposing at least some of the flexible member in contact with the adhesive.

21. The method of claim 14, further comprising positioning a shield on the flexible member after wrapping the flexible member on the tubular.

22. The method of claim 14, wherein the flexible member comprises a mandrel and a sheath covering at least a portion of the mandrel, and wherein applying the tension comprises contracting the flexible member by pulling ends of the mandrel such that the mandrel moves relative to the sheath.

23. The method of claim 14, wherein applying the tension to the flexible member comprises heating the flexible member before, during, or after wrapping the flexible member around the tubular.

24. An apparatus for securing to a tubular, comprising:

a helical flexible member positioned around the tubular, such that the flexible member applies a radially-inward gripping force on the tubular, wherein the flexible member defines a plurality of turns around the tubular that are adjacent in a direction that is parallel to a central axis of the tubular;

a layer of adhesive interposed between at least a portion of the flexible member and the tubular; and an insert positioned radially between the flexible member and the tubular, wherein the insert comprises a material that is softer than the flexible member, the tubular, or both, and wherein the insert comprises a plurality of segments that are circumferentially adjacent and each include an elongate body disposed between the flexible member and the tubular and a head, the heads of the plurality of segments collectively defining at least one end ring that is axially adjacent to the flexible member.

25. The apparatus of claim 24, further comprising a coating disposed on the flexible member, such that the flexible member is radially interposed between at least a portion of the coating and the tubular, wherein the coating is configured to be exposed to a wellbore when the tubular is deployed therein.

26. The apparatus of claim 25, wherein the coating extends past an axial end of the flexible member.

27. The apparatus of claim 24, wherein the flexible member comprises a helical spring having a natural diameter that is less than an outer diameter of the tubular.

* * * * *